US007874870B1

(12) United States Patent
Chen

(10) Patent No.: US 7,874,870 B1
(45) Date of Patent: Jan. 25, 2011

(54) COAXIAL CABLE CONNECTOR WITH A CONNECTION TERMINAL HAVING A RESILIENT TONGUE SECTION

(75) Inventor: Ming-Ching Chen, Taipei (TW)

(73) Assignee: EZCONN Corporation, Taipei (TW)

( * ) Notice: Subject to any disclaimer, the term of this patent is extended or adjusted under 35 U.S.C. 154(b) by 0 days.

(21) Appl. No.: 12/727,587

(22) Filed: Mar. 19, 2010

(51) Int. Cl.
*H01R 9/05* (2006.01)

(52) U.S. Cl. ..... 439/582

(58) Field of Classification Search ..... 439/582, 439/63

See application file for complete search history.

(56) References Cited

U.S. PATENT DOCUMENTS 7,704,096 B2 * 4/2010 Liao et al. ..... 439/582

* cited by examiner

*Primary Examiner*—Tho D Ta
(74) *Attorney, Agent, or Firm*—Rosenberg, Klein & Lee

(57) ABSTRACT

A coaxial cable connector includes a connection terminal having at least one resilient tongue section for supporting an internal conductor of a coaxial cable, and a metal case for supporting the connection terminal via an insulating member. The resilient tongue section of the connection terminal is able to provide a resilient restoring force in response to a pressing force of the insulating member, whereby the internal conductor of the coaxial cable can be retained between the insulating member and the resilient tongue section to establish electrical connection between the internal conductor of the coaxial cable and the connection terminal.

3 Claims, 9 Drawing Sheets

COAXIAL CABLE CONNECTOR WITH A CONNECTION TERMINAL HAVING A RESILIENT TONGUE SECTION

BACKGROUND OF THE INVENTION

1. Field of the Invention

The present invention relates generally to a coaxial cable connector, and more particularly to a coaxial cable connector in which the connection terminal can be securely connected with an internal conductor of a coaxial cable for reliable transmission of electrical signals.

2. Description of the Related Art

Numerous coaxial cables are used for the internal wiring of IT devices such as laptop computers and compact electronic devices such as home electric appliances, and such coaxial cables are usually used by being electrically connected to the respective conductors of other cables, substrates or the like.

In order to electrically connect such coaxial cables to, for example, a conductor of another cables, conventionally, internal conductors of the respective coaxial cables are one by one soldered to the conductor of other corresponding cables. As a result, internal conductors of coaxial cables were electrically connected to the conductors of other cables.

Nevertheless, with this electrical connection method, connection errors during the soldering process would often occur, and there is a problem in that the electrical connection between the internal conductors of coaxial cables and the conductors of other cables could not be conducted with precision.

Moreover, since the soldering process is complicated, there is a problem in that much time is required for the connection process, and that the loss is great due to failures of the connection process.

In order to overcome such problems, conventionally, a coaxial cable connector has been proposed as a device for electrically connecting the internal conductors of coaxial cables and the conductors of other cables.

U.S. Pat. No. 6,790,082 discloses a coaxial cable connector including a connection terminal to be connected to an internal conductor of a coaxial cable, and a metal shell for supporting the connection terminal via an insulator. The connection terminal is bent with respective bending forces of the shell and the insulator to make a pair of contact plates of the connection terminal retain the internal conductor of the coaxial cable. Accordingly, electrical connection is established between the internal conductor of the coaxial cable and the connection terminal.

In the above structure, the internal conductor of the coaxial cable is clamped from upper and lower sides by the pair of contact plates to establish the electrical connection between the internal conductor of the coaxial cable and the connection terminal. However, the internal conductor of the coaxial cable can be hardly securely retained by means of the contact plates. This often leads to poor contact between the internal conductor and the contact plates. As a result, it cannot be ensured that the contact plates are lastingly electrically connected with the internal conductor of the coaxial cable and the quality of signal transmission will be affected. Moreover, the internal conductor may be damaged due to clamping of the contact plates. This will result in deterioration of the electrical signal transmission performance of the coaxial cable connector.

SUMMARY OF THE INVENTION

A primary object of the present invention is to provide a coaxial cable connector, which can be effectively mechanically and electrically connected with an internal conductor of a coaxial cable.

To achieve the above and other objects, the coaxial cable connector of the present invention includes a connection terminal having at least one resilient tongue section for supporting an internal conductor of a coaxial cable, and a metal case for supporting the connection terminal via an insulating member. The resilient tongue section of the connection terminal is able to provide a resilient restoring force in response to a pressing force of the insulating member, whereby the internal conductor of the coaxial cable can be retained between the insulating member and the resilient tongue section to establish electrical connection between the internal conductor of the coaxial cable and the connection terminal.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
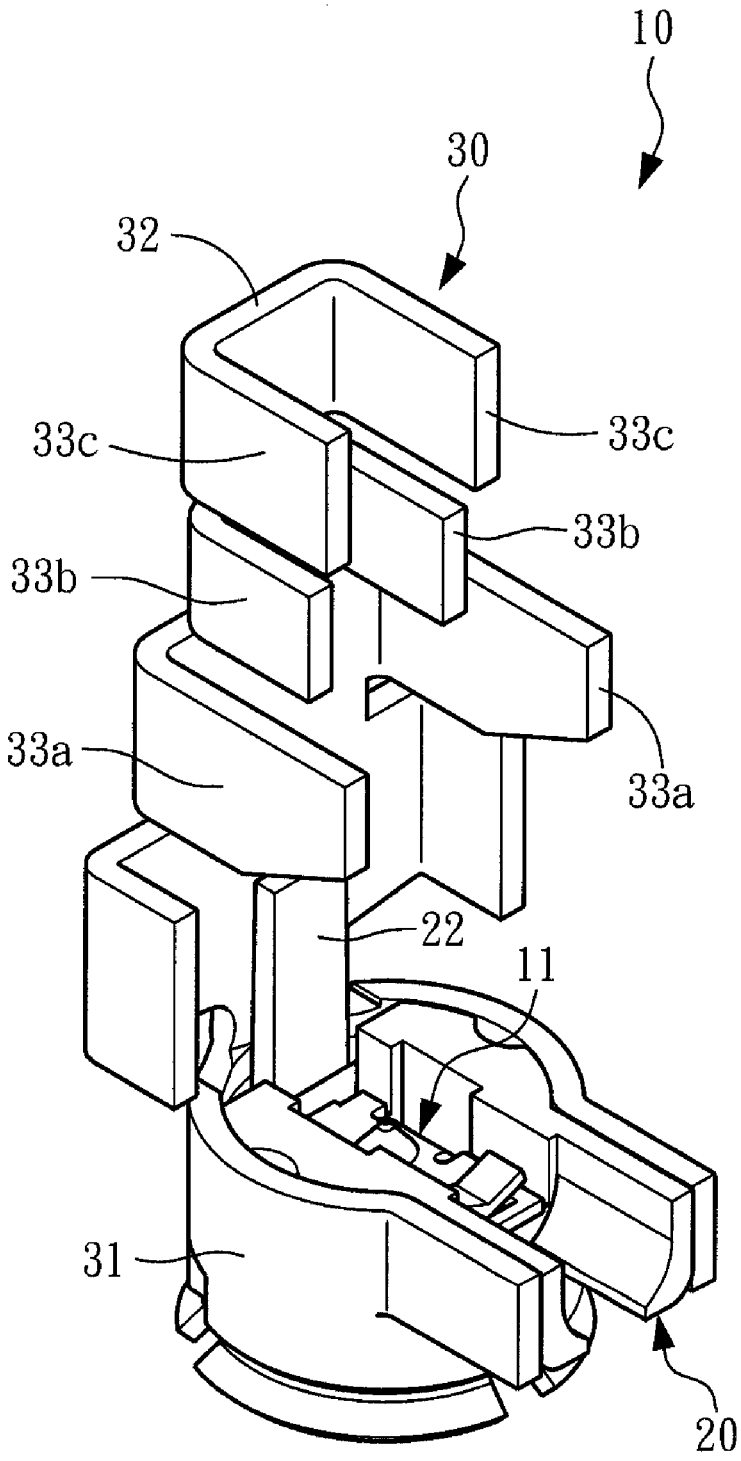
FIG. 1 is a perspective assembled view of the coaxial cable connector of the present invention.
Figure 2:
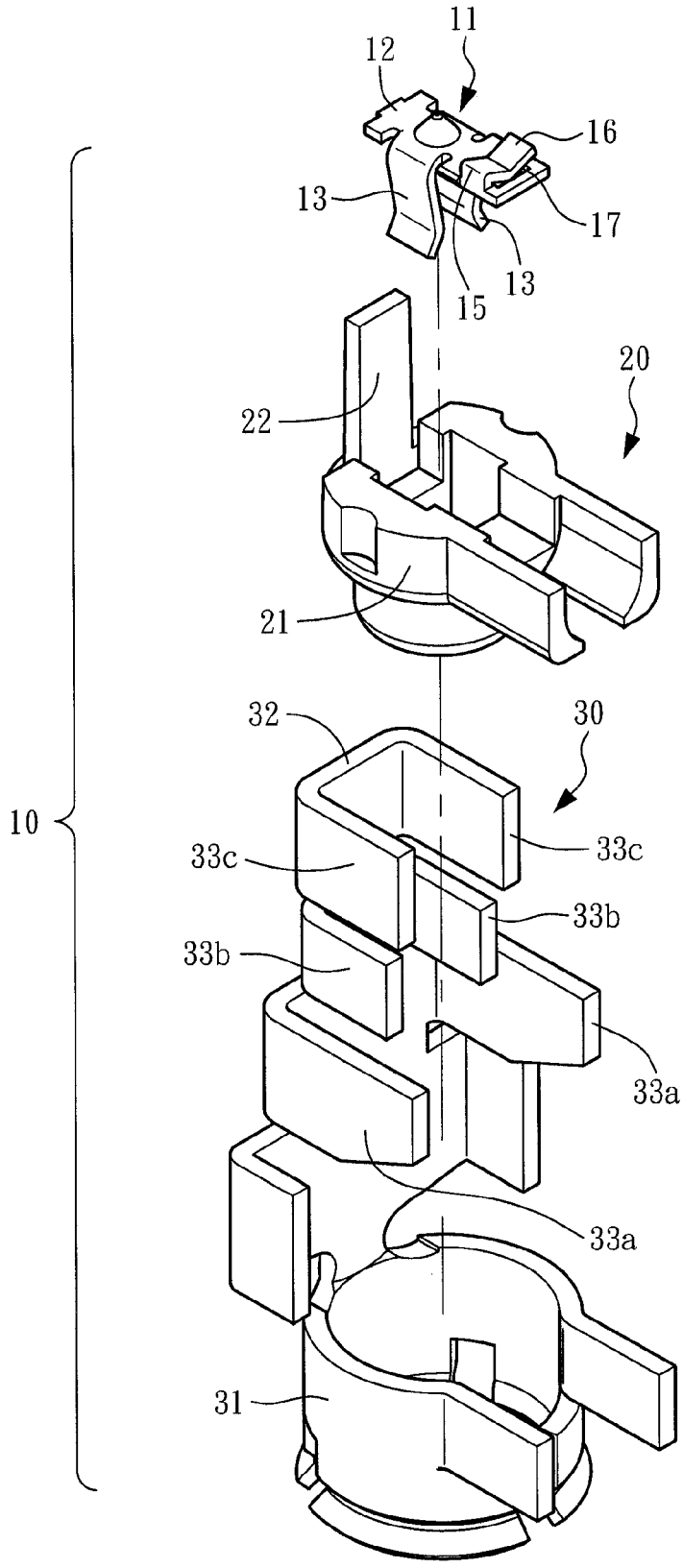
FIG. 2 is a perspective exploded view of the coaxial cable connector of the present invention.

Please refer to FIGS. 1 and 2, in which FIG. 1 is a perspective assembled view of the coaxial cable connector of the present invention and FIG. 2 is a perspective exploded view of the coaxial cable connector of the present invention. The coaxial cable connector 10 includes a connection terminal 11, an insulating member 20 and a metal case 30.

Figures 3, 4, 5A:
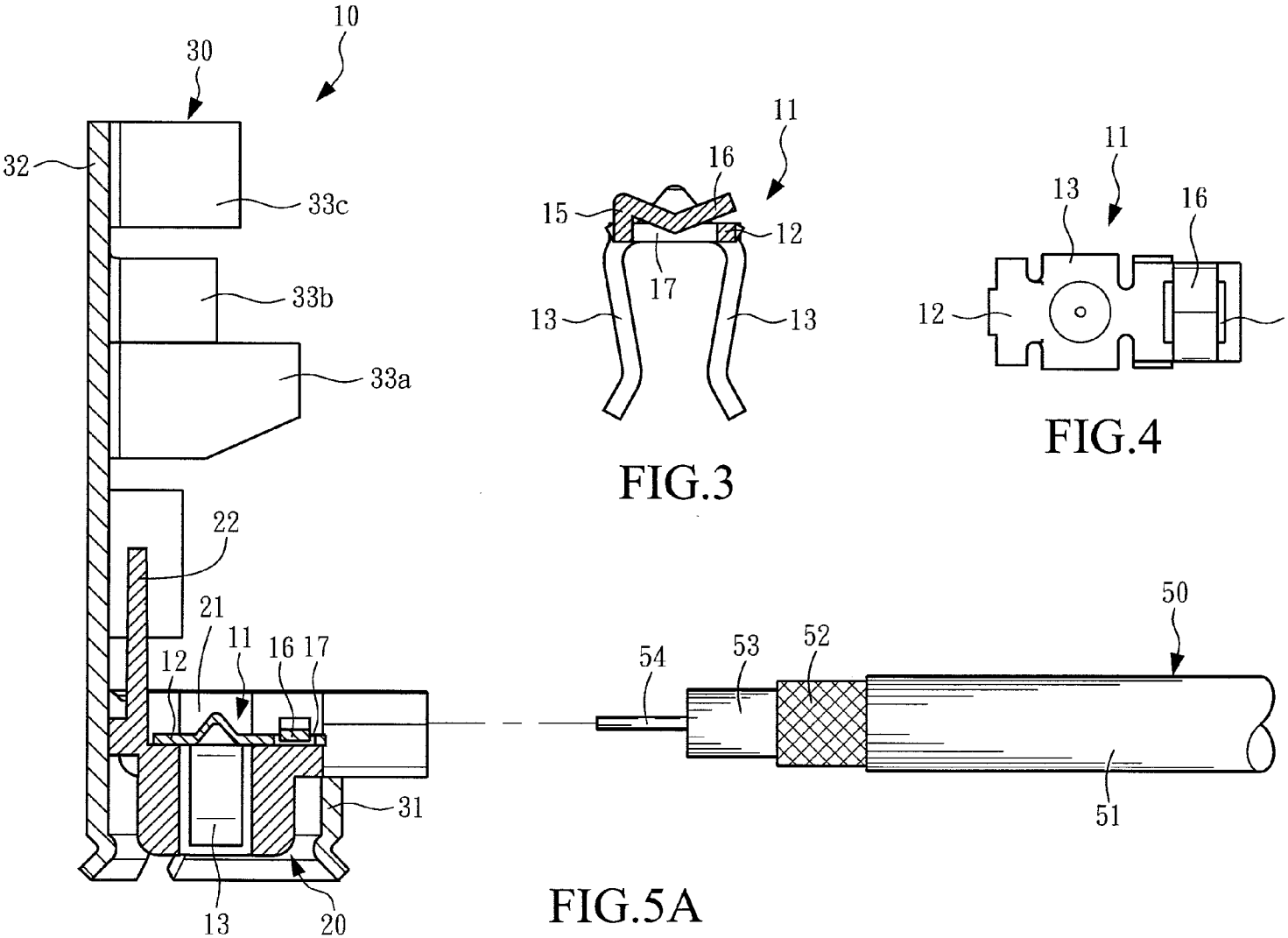
FIG. 3 is a sectional view of the connection terminal of the coaxial cable connector of the present invention.
FIG. 4 is a top view of the connection terminal of the coaxial cable connector of the present invention.
FIGS. 5A to 5C show the installation process of the coaxial cable on the coaxial cable connector of the present invention.

Referring to FIGS. 3 and 4, the connection terminal 11 includes a base section 12, a pair of connection sections 13 downward extending from two sides of the base section 12 and at least one resilient tongue section 16. The resilient tongue section 16 has an end wall 15 connected with one side of the base section 12. As shown in FIG. 3, the resilient tongue section 16 extends from a free end of the end wall 15 and is bent downward. In this embodiment, there is only one resilient tongue section 16 for illustration purpose. The resilient tongue section 16 extends from the free end of the end wall 15 to the other side of the base section 12 by a predetermined length in the form of a cantilever for supporting an internal conductor 54 of a coaxial cable 50 to establish electrical connection between the internal conductor 54 of the coaxial cable 50 and the connection terminal 11 (with reference to FIG. 5C).

In addition, the base section 12 of the connection terminal 11 further has a perforation 17 corresponding to the resilient tongue section 16, whereby the resilient tongue section 16 is movable within the perforation 17.

The insulating member 20 is disposed between the connection terminal 11 and the metal case 30. The insulating member 20 has: an insulating main body 21 for supporting the base section 12 of the connection terminal 11; and an insulating bendable section 22 upward extending from one side of the insulating main body 21. The insulating bendable section 22 can be bent toward the insulating main body 21.

The metal case 30 has: a case main body 31 for supporting the insulating main body 21 of the insulating member 20; a case bendable section 32 positioned in parallel to the insulating bendable section 22 of the insulating member 20, the case bendable section 32 and the insulating bendable section 22 can be bent at the same time; and first connection sections 33*a* formed on two sides of the case bendable section 32.

The metal case 30 further has second connections 33*b* formed on two sides of the case bendable section 32 and third connection sections 33*c* also formed on two sides of the case bendable section 32.

Figure 5B:
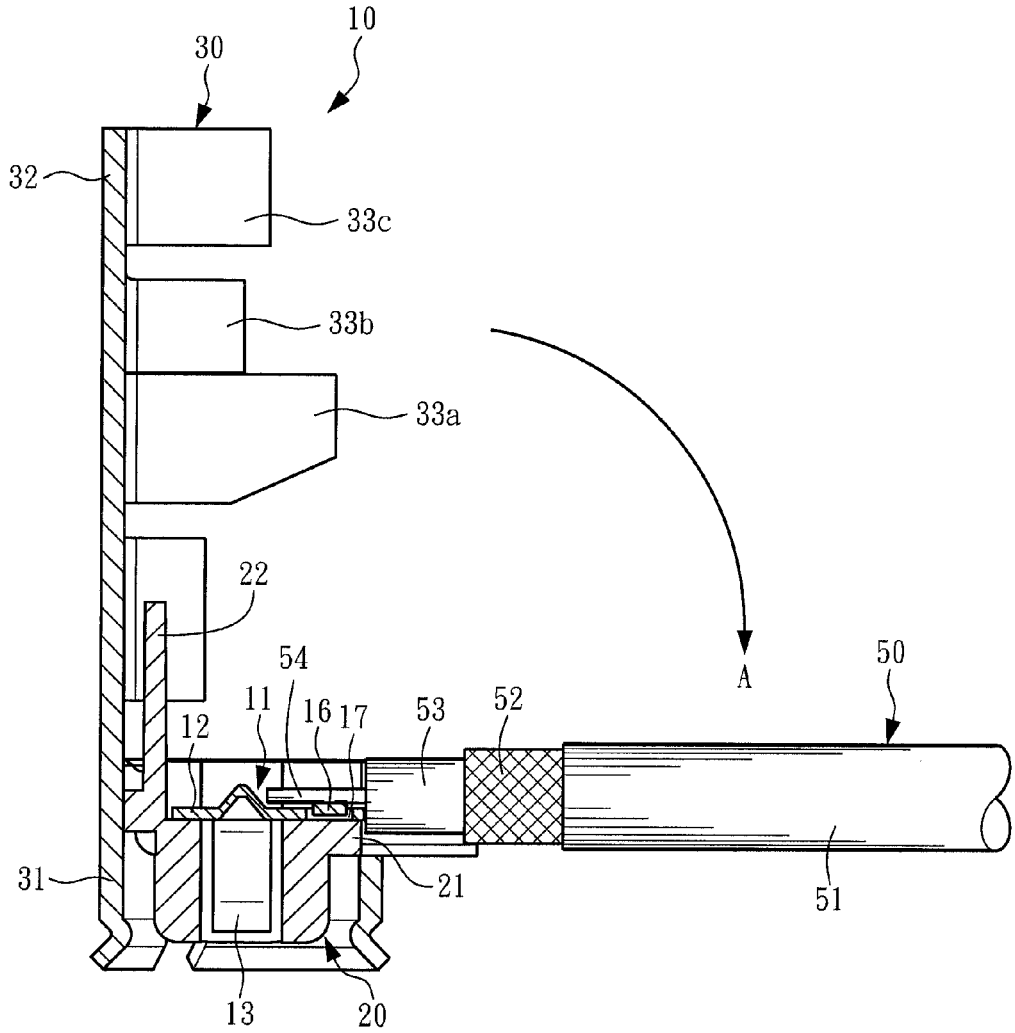
Figure 5C:
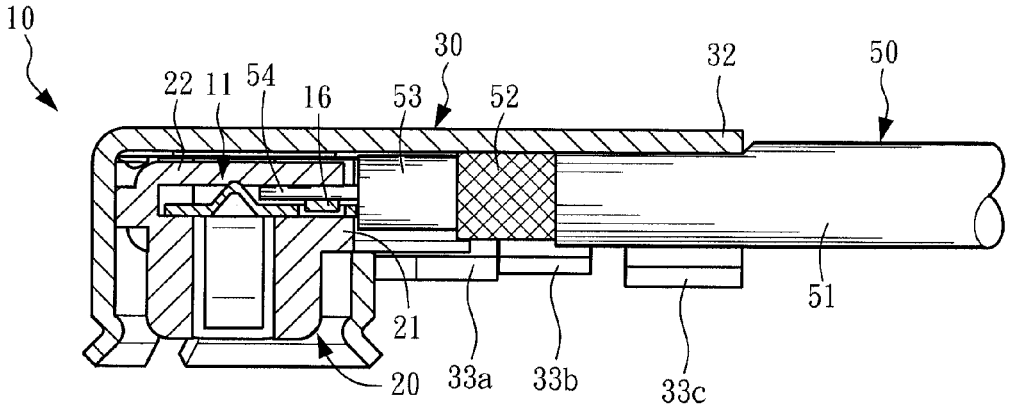
Figure 9A:
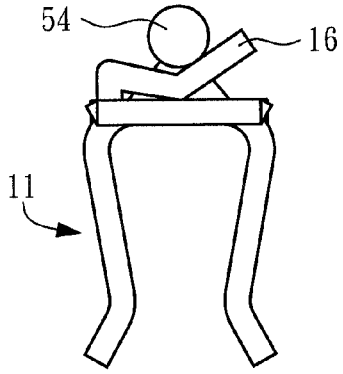
FIG. 9A is a view showing that the internal conductor of the coaxial cable is positioned at a bent portion of the resilient tongue section of the connection terminal.

FIGS. 5A to 5C show the installation process of the coaxial cable 50 on the coaxial cable connector 10. The skin 51 of a free end of the coaxial cable 50 is partially removed to expose an external conductor 52, an insulator 53 and the internal conductor 54. In a first step, the coaxial cable 50 is inserted into the connection terminal 11 of the coaxial cable connector 10 as shown in FIG. 5A. At this time, the internal conductor 54 of the coaxial cable 50 is positioned at a bent portion of the resilient tongue section 16 of the connection terminal 11 as shown in FIGS. 5B and 9A.

Figure 9B:
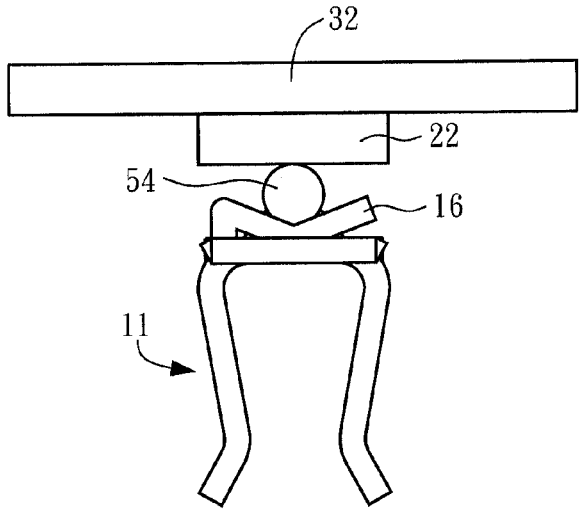
FIG. 9B is a view showing that the case bendable section of the metal case and the insulating bendable section of the insulating member are bent to clamp the internal conductor of the coaxial cable and establish reliable mechanical and electrical connection between the internal conductor and the resilient tongue section of the connection terminal.

Then, a force in the direction of arrow A is applied to the metal case 30 to forcedly bend the case bendable section 32 of the metal case 30 and the insulating bendable section 22 of the insulating member 20 to an eventual connection position. In the eventual connection position, the internal conductor 54 of the coaxial cable 50 is clamped by the downward pressing force of the insulating bendable section 22 and the upward resilient force of the resilient tongue section 16 and retained between the insulating bendable section 22 and the resilient tongue section 16. Under such circumstance, the internal conductor 54 of the coaxial cable 50 is reliably mechanically and electrically connected with the resilient tongue section 16 of the connection terminal 11 as shown in FIGS. 5C and 9B.

Moreover, the case bendable section 32 is securely connected with the case main body 31 via the first connection sections 33*a*. In addition, the case bendable section 32 and the second connection sections 33*b* together hold the external conductor 53 of the coaxial cable 50. Also, the case bendable section 32 and the third connection sections 33*c* together hold the skin 51 of the coaxial cable 50. Accordingly, the coaxial connector 10 can be tightly connected with the free end of the coaxial cable 50.

Figure 6:
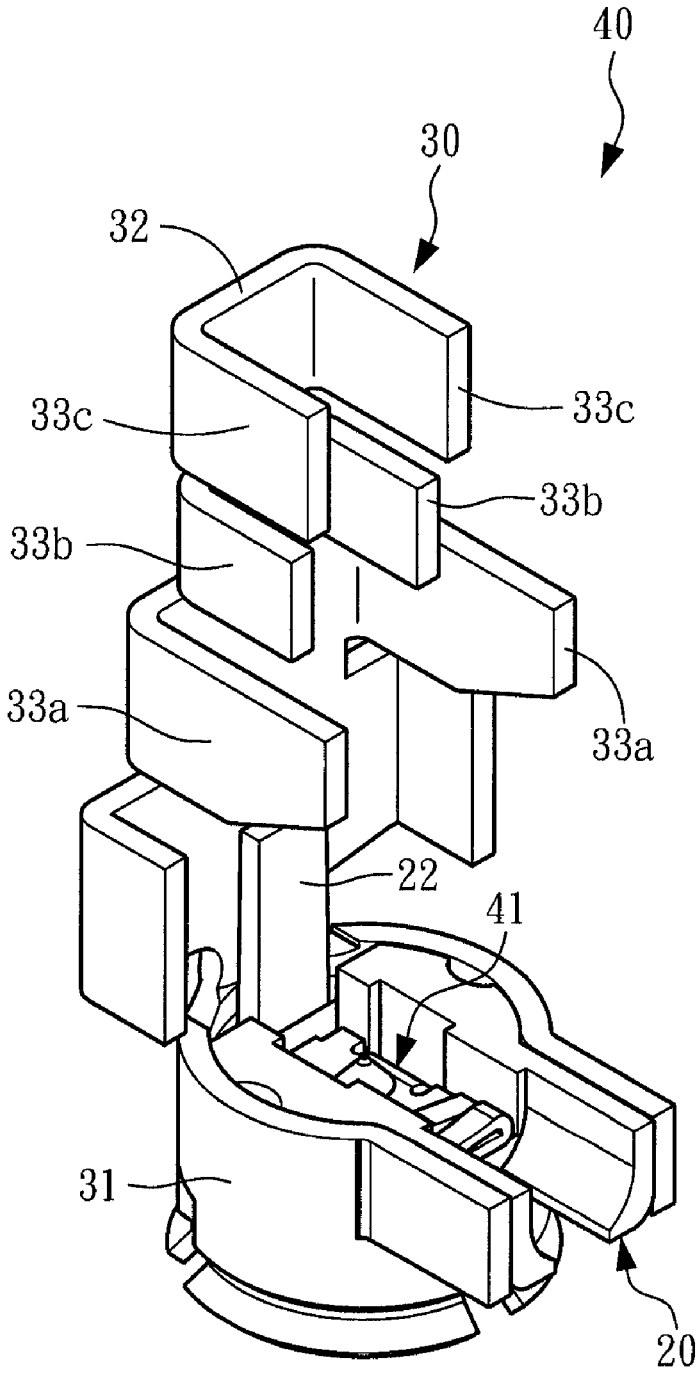
FIG. 6 is a perspective assembled view of another embodiment of the coaxial cable connector of the present invention.
Figure 7:
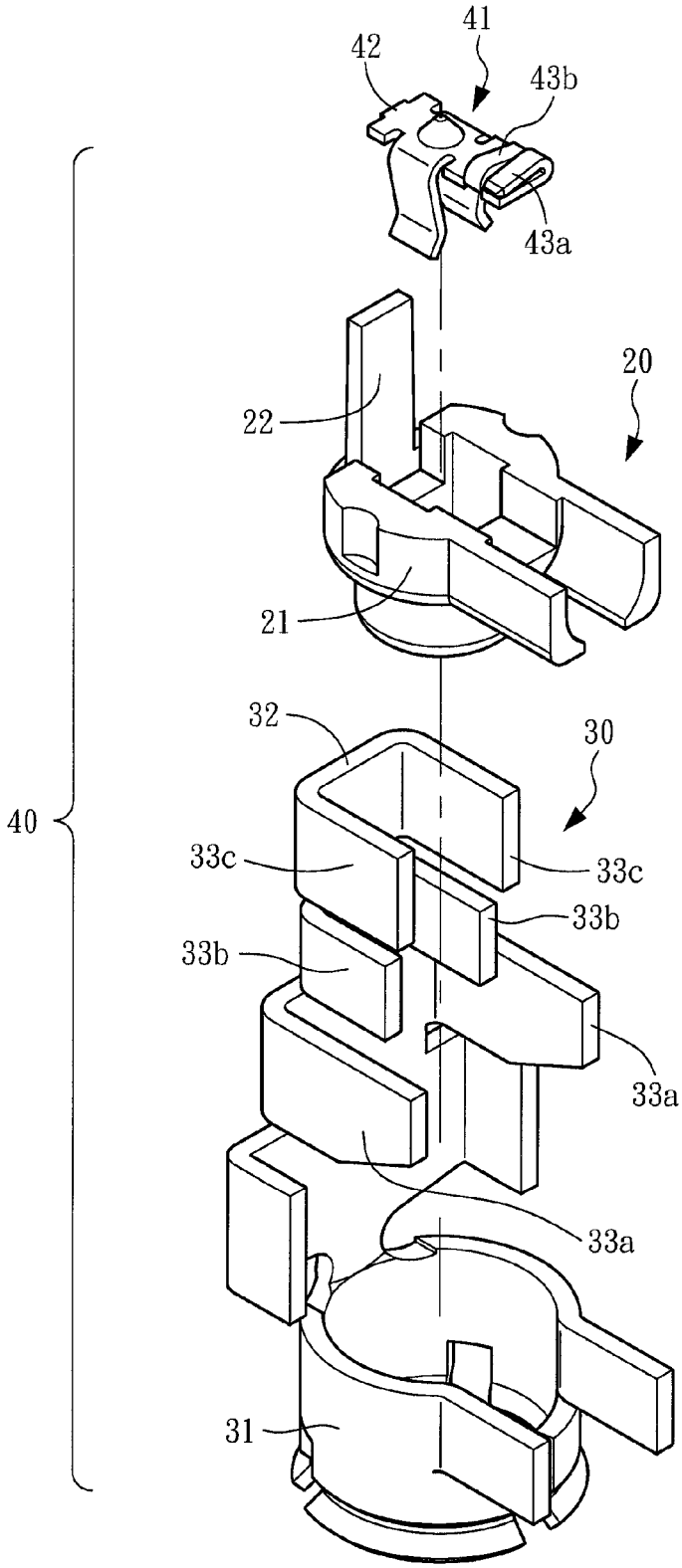
FIG. 7 is a perspective exploded view of the other embodiment of the coaxial cable connector of the present invention, showing that the connection terminal has two resilient tongue sections side by side disposed on the base section in an intersecting pattern.

FIGS. 6 and 7 show a second embodiment of the coaxial cable connector 40 of the present invention, in which the same components are denoted by the same reference numerals as those in FIGS. 1 and 2. The second embodiment of the coaxial cable connector 40 of the present invention substantially is identical to the first embodiment of FIGS. 1 and 2 in configuration and size and includes the same components as the first embodiment. The second embodiment is only different from the first embodiment in that the connection terminal 41 has two resilient tongue sections 43*a*, 43*b* separated from each other. As shown in FIG. 7, the two resilient tongue sections 43*a*, 43*b* are side by side disposed on the base section 42 in an intersecting pattern. The resilient tongue sections 43*a*, 43*b* intersect each other in an intersecting position where the internal conductor 54 of the coaxial cable 50 is supported and electrically connected with the connection terminal 41 (with reference to FIG. 8C).

Figure 8A:
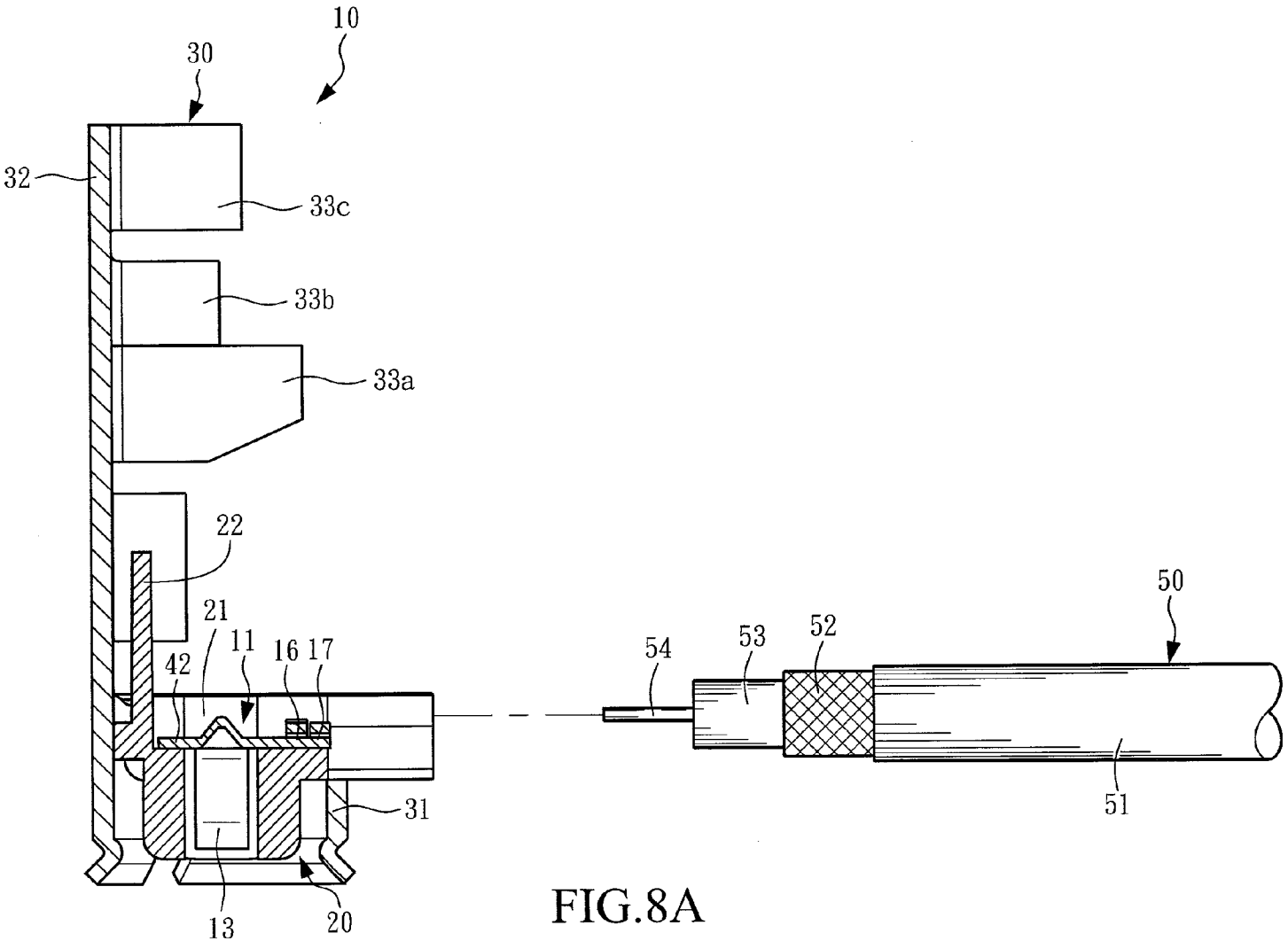
FIGS. 8A to 8C show the installation process of the coaxial cable on the coaxial cable connector of FIG. 6.
Figure 8B:
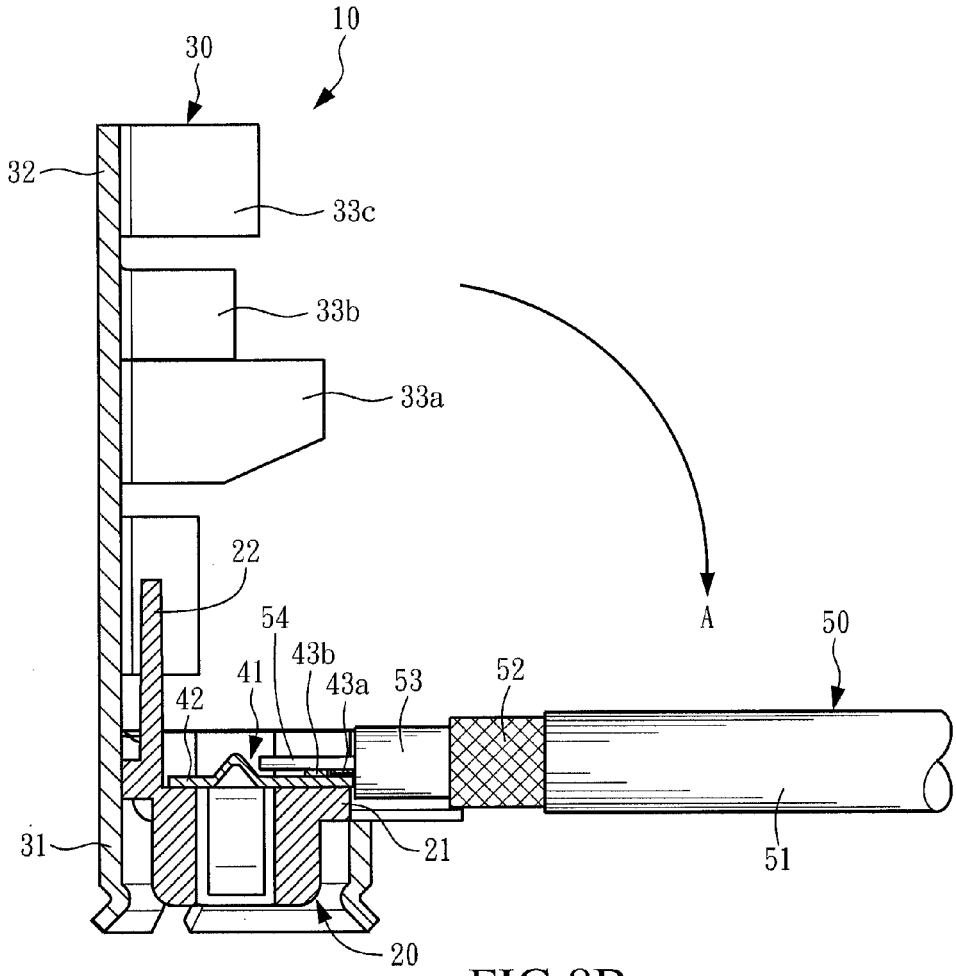
Figure 8C:
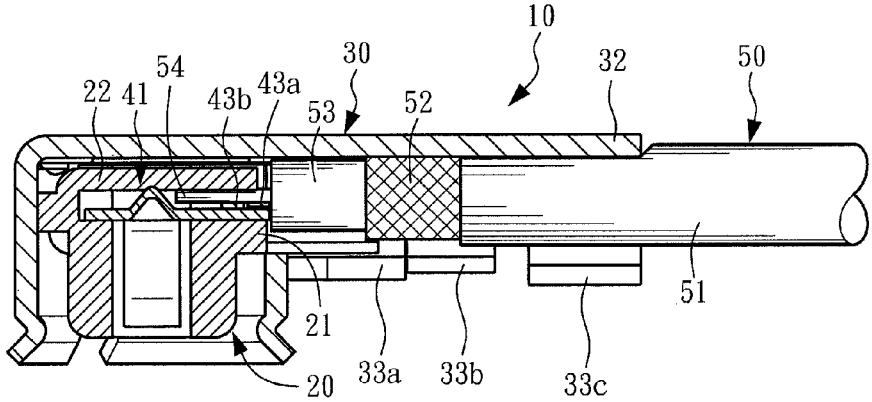
Figure 10A:
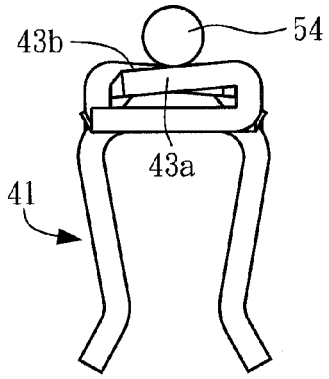
FIG. 10A is a view showing that the internal conductor of the coaxial cable is positioned in the intersecting position of two resilient tongue sections of the connection terminal.

FIGS. 8A to 8C show the installation process of the coaxial cable 50 on the coaxial cable connector 40. First, the free end of the coaxial cable 50 is inserted into the connection terminal 41 of the coaxial cable connector 40 as shown in FIG. 8A. At this time, the internal conductor 54 of the coaxial cable 50 is positioned in the intersecting position of the resilient tongue sections 43*a*, 43*b* of the connection terminal 11 as shown in FIGS. 8B and 10A.

Figure 10B:
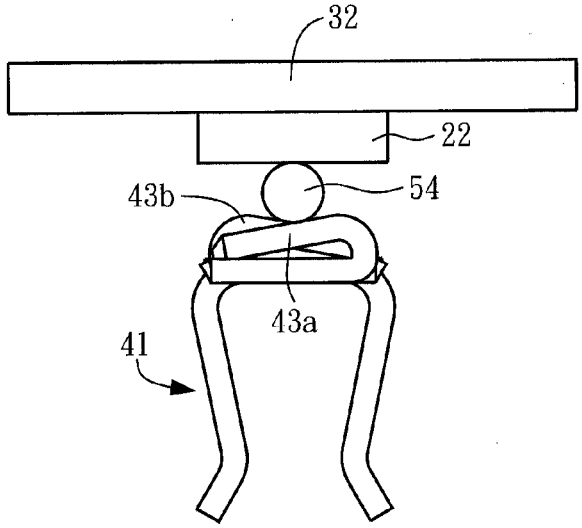
FIG. 10B is a view showing that the case bendable section of the metal case and the insulating bendable section of the insulating member are bent to clamp the internal conductor of the coaxial cable and establish reliable mechanical and electrical connection between the internal conductor and the resilient tongue sections of the connection terminal.

Then, a force in the direction of arrow A is applied to the metal case 30 to forcedly bend the case bendable section 32 of the metal case 30 and the insulating bendable section 22 of the insulating member 20 to an eventual connection position. In the eventual connection position, the internal conductor 54 of the coaxial cable 50 is clamped by the downward pressing force of the insulating bendable section 22 and the upward resilient force of the resilient tongue sections 43*a*, 43*b* and retained between the insulating bendable section 22 and the resilient tongue sections 43*a*, 43*b*. Under such circumstance, the internal conductor 54 of the coaxial cable 50 is reliably mechanically and electrically connected with the resilient tongue sections 43*a*, 43*b* of the connection terminal 41 as shown in FIGS. 8C and 10B.

In conclusion, in the coaxial cable connectors 10, 40 of the present invention, the internal conductor 54 of the coaxial cable 50 is clamped by the pressing force of the insulating bendable section 22 and the resilient restoring force of one resilient tongue section 16 or two resilient tongue sections 43*a*, 43*b* so as to establish reliable mechanical and electrical connection between the internal conductor 54 of the coaxial cable 50 and the connection terminals 11, 41. In this case, the internal conductor 54 is protected from damage and a good connection between the internal conductor 54 and the connection terminals 11, 41 can be ensured for transmission of electrical signals.

The above embodiments are only used to illustrate the present invention, not intended to limit the scope thereof. It is understood that many changes or modifications of the above embodiments can be made by those who are skilled in this field without departing from the spirit of the present invention. The scope of the present invention is limited only by the appended claims.

What is claimed is:

1. A coaxial cable connector comprising:

a connection terminal having at least one resilient tongue section for supporting an internal conductor of a coaxial cable, the connection terminal including a base section, the resilient tongue section having an end wall connected with one side of the base section, the resilient tongue section extending from a free end of the end wall and being bent downwardly; and a metal case for supporting the connection terminal via an insulating member, the resilient tongue section of the connection terminal being able to provide a resilient restoring force in response to a pressing force of the insulating member, whereby the internal conductor of the coaxial cable can be retained between the insulating member and the resilient tongue section to establish electrical connection between the internal conductor of the coaxial cable and the connection terminal.

2. The coaxial cable connector as claimed in claim 1, wherein the base section has a perforation corresponding to the resilient tongue section, whereby the resilient tongue section is movable within the perforation.

3. A coaxial cable connector comprising:

a connection terminal having at least one resilient tongue section for supporting an internal conductor of a coaxial cable, the connection terminal having two resilient tongue sections, the two resilient tongue sections being separated from each other and arranged in an intersecting pattern; and a metal case for supporting the connection terminal via an insulating member, the resilient tongue section of the connection terminal being able to provide a resilient restoring force in response to a pressing force of the insulating member, whereby the internal conductor of the coaxial cable can be retained between the insulating member and the resilient tongue section to establish electrical connection between the internal conductor of the coaxial cable and the connection terminal.

* * * * *